United States Patent [19]

Kice

[11] 4,202,657

[45] May 13, 1980

[54] FLUID PUMP

[75] Inventor: John E. Kice, Wichita, Kans.

[73] Assignee: K-B Engineering Co., Wichita, Kans.

[21] Appl. No.: 628,740

[22] Filed: Nov. 4, 1975

[51] Int. Cl.[2] ..... F04C 17/00; F04C 29/00

[52] U.S. Cl. ..... 418/208

[58] Field of Search ..... 418/58, 205

[56] References Cited

U.S. PATENT DOCUMENTS

| | | | |
|---|---|---|---|
| 46,457 | 2/1865 | Ellis | 418/208 |
| 128,572 | 7/1872 | Whitcher | 418/208 |
| 1,582,960 | 5/1926 | Berrenberg | 418/208 |
| 3,162,139 | 12/1964 | Thompson | 418/58 |
| 3,190,228 | 6/1965 | Grigar | 418/208 |
| 3,861,362 | 1/1975 | Kenyon | 418/208 |

FOREIGN PATENT DOCUMENTS

| | | | |
|---|---|---|---|
| 594469 | 6/1925 | France | 418/208 |
| 708155 | 4/1931 | France | 418/208 |
| 116424 | 9/1926 | Switzerland | 418/208 |
| 117042 | 12/1926 | Switzerland | 418/208 |
| 244445 | 4/1926 | United Kingdom | 418/208 |

*Primary Examiner*—John J. Vrablik

*Attorney, Agent, or Firm*—John H. Widdowson

[57] ABSTRACT

An improved fluid pump having two or more cylindrical eccentric or elliptical rotors drive connected to revolve together at identical angular velocities, and positioned in cylindrical chambers for compressing fluids therein. The pump includes separate intake ports and discharge ports to and from the chambers allowing the pump to be used as a single stage pump or by connecting the discharge port of one chamber with the intake port of the other chamber the pump can be used as a two stage pump for increased pressure with less volume.

5 Claims, 3 Drawing Figures

FLUID PUMP

BACKGROUND OF THE INVENTION

This invention relates generally to fluid pumps or compressors and more particularly but not by way of limitation to rotary pumps having eccentric or elliptical rotors mounted in adjacent cylindrical chambers.

Heretofore there have been various types of rotary pumps having a pair of eccentric rotors mounted in adjacent cylindrical chambers with a passageway between the chambers. Mounted in the passageway is a slidably mounted valve. The ends of the valve are disposed against a portion of the cylindrical sides of the rotors. These pumps have a single intake and discharge port connected to the valve. As the valve slides back and forth in the passageway, the valve directs the fluid into the chambers and discharges the compressed fluid into the discharge port.

There are similar prior art rotary pumps to the above which include sleeves mounted around the eccentric rotors. These sleeves are attached to a slide which is mounted in a passageway between the chambers. These types of pumps also have a single intake and discharge port for receiving and discharging the compressed fluid from the two chambers. The pumps require sealed lubrication for the valves, sleeves and other parts or the pump application must be limited to fluids having lubricating capability.

None of the prior art pumps disclose the novel features of the subject invention as herein described.

SUMMARY OF THE INVENTION

The improved rotary pump is simple in design and eliminates the need of complex valving in the pump housing and internal lubrication.

The separate cylindrical chambers in the pump housing each contain separate intake and discharge ports. The separate porting allows the pump to be used as either a single stage pump or by connecting the discharge port of one chamber with the intake port of the other chamber the pump can be used as a two stage pump for higher pressure.

The arrangement of the pump also permits using one section of the unit to compress a gas such as air, then after removing the heat of compression from the gas by passing it through a heat exchanger, the compressed gas is passed through the second section where it expands, turning the second rotor which is drive connected to the first rotor. Thus the expanding gas returns part of the energy used to compress it, and the energy thus consumed further reduces the gas temperature. This refrigerating effect may be used in many ways. Likewise, the heat of compression removed in the heat exchanger may be utilized.

A floating block is mounted in a guideway. The guideway interconnects the two chambers. The ends of the block are disposed adjacent to cylindrical portions of the rotors maintaining a small but equal clearance as the rotors revolve together. The block acts as a barrier to maintain pressure differentials between the two adjacent chambers and between the intake port and the discharge port of each chamber. However, due to the pressure differential, a small amount of fluid will flow through the clearance spaces between the ends of the block and the two rotors. Also a small amount of fluid will flow in the spaces between the sides of the block and the guideway. During operation this leakage provides a flow rate sufficient to float the block as it moves back and forth in the guideway, and also keeps the ends of the block centered between the tangent surfaces of the two rotors, as they rotate together in the same angular phase relationship.

This application of the fluid bearing principle floats the block during pump operation, so that contact between the block and the surface of the guideway is prevented, thereby reducing friction, reducing wear and reducing the high cost of maintenance in the purchase of replacement parts. Therefore a complicated lubrication system is eliminated. However, it may be practical to line the guideway or make the block out of some type of self-lubricating material such as graphite, teflon or impregnated porous metal or plastic. This will prevent wear during starting or shut down times when the pump speed may be too slow to activate the air bearing for a brief period. With the internal lubrication system eliminated, the internal portions of the pump are free of oil, permitting fluids to be pumped without the possibility of being contaminated by oil.

The pump includes a pump housing, a pair of cylindrical chambers in the housing, a pair of cylindrical eccentric rotors positioned in the chambers and rotatably attached to the housing, intake and discharge ports to the chambers, a guideway interconnecting the chambers, a floating block slidably mounted in the guideway, the ends of the block disposed adjacent a portion of the cylindrical surface of the rotors, and drive means for rotating the rotors at identical angular velocities in the chambers.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
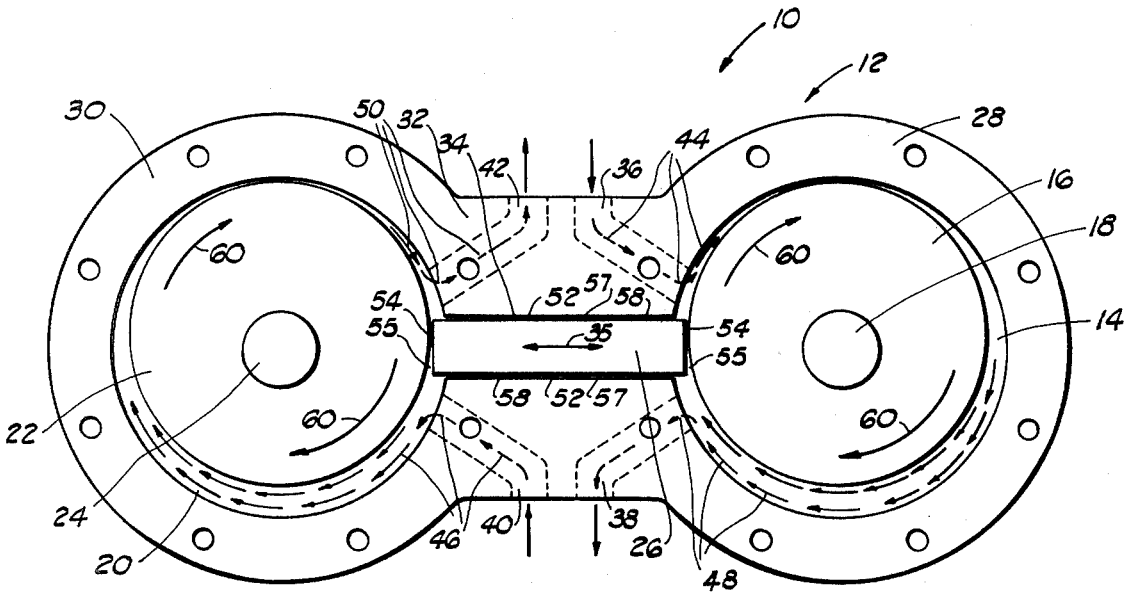
FIG. 1 is a side view of the improved fluid pump with the end plates of the pump removed. The eccentric rotors are shown rotated in the same direction.

In FIG. 1 the improved fluid pump is designated by the general reference number 10. The pump 10 includes a pump housing 12, a first cylindrical chamber 14, a first cylindrical eccentric rotor 16 mounted on a first rotor shaft 18, a second cylindrical chamber 20, a second cylindrical eccentric rotor 22 mounted on a second rotor shaft 24, and a floating block 26. While the improved fluid pump 10 is described in detail as acting as a pump it is understood that it could act also as a compressor.

The pump housing 12 includes a first end portion 28 with the first chamber 14 therein, a second end portion 30 with the second chamber 20 therein, and a center portion 32 having a guideway 34 therethrough connecting the first chamber 14 and second chamber 20. The floating block 26 is slidably mounted in the guideway 34. The direction of movement of the block 26 is indicated by arrow 35.

The center portion 32 of the pump housing 12 further includes a first intake port 36 connected to the chamber 14 and a first discharge port 38 connected to the first chamber 14. The center portion 32 also includes a second intake port 40 connected to the second chamber 20 and a second discharge port 42 connected to second chamber 20.

In this view the end plates of the pump 10 are removed so that a cross section of the pump can be seen exposing the rotatably mounted eccentric rotors 16 and 22. The rotors 16 and 22 have a portion of their cylindrical surface tangent to the sides of the chambers 14 and 20 at a twelve o'clock position. In this position a portion of the chambers 14 and 20 are shown receiving fluid to be compressed through the intake ports 36 and 40 and represented by arrows 44 and 46. In a separate portion of the chambers 14 and 20 the fluid represented by arrows 48 and 50 is being compressed and discharged through discharge ports 38 and 42.

The floating block 26 includes sides 52 and end portions 54. It should be noted in this view that while the end portions 54 of the block 26 are disposed adjacent the rotating rotors 16 and 22, a clearance 55 is provided between the cylindrical surface of the rotors and the end portions 54 so that a pressure differential of the fluid between the intake ports 36 and 40 and the discharge ports 38 and 42 provide a fluid bearing between the end portions 54 and the cylindrical surface of the rotors. As a clearance 57 between sides 58 of the guideway 34 and sides 52 of the block 26 allows a limited flow of the fluid between the chambers 14 and 20. During operation of the pump 10 the pressure differential between the two chambers provides a fluid bearing between the sides 52 of the floating block 34 and the sides 58 of the guideway 26. The block 26 is rectangular in shape. The block 26 may be solid, hollow or made with cavities to remove weight. Its surfaces may be made of self-lubricating material such as teflon, molybdenum, graphite, impregnated porous metal or the like.

During the startup of the pump 10, the sides 52 and the end portion 54 of the floating block 26 will briefly contact the sides 58 of the guideway 34 and a portion of the cylindrical surface of the rotors 16 and 22. The solid lubricant on the block 26 will prevent metal to metal contact between the rubbing surfaces as the block 26 moves back and forth in the guideway 34. When the rotors 16 and 22 reach operating speed the pressure differential in the chambers 14 and 20 is sufficient to cause the block 26 to begin floating on the fluid bearing in the clearances 55 and 57. While the clearances 55 and 57 are sufficient enough to provide fluid flow (i.e. 0.001 inches to 0.005 inches) in order to provide the fluid bearing, in turn the clearance 55 is small enough to allow the floating block 26 to act as an effective seal between the intake ports and the discharge ports in the chambers 14 and 20 as the fluid is being compressed. Also the clearance 57 in the guideway 34 is small enough so that the block 26 is also an effective seal between the two chambers 14 and 20.

In this figure the first rotor shaft 18 and the second rotor shaft 24 rotate the eccentric rotors 16 and 22 in a clockwise position as indicated by arrows 60. By rotating both of the rotors in the same direction the discharge port 38 is adjacent to the intake port 40 at the bottom of the center position 32 of the housing 12. This port arrangement makes the pump 10 readily adaptable for connecting these two ports together so that the pump 10 can be used as a two stage pump. Should this arrangement be desired the compressed fluid in the first chamber 14 would be routed via discharge port 38 into intake port 40 and then into the second chamber 20 thereby providing additional two stage compression of the fluid and providing higher fluid pressures discharged through the second discharge port 42. An intermediate heat exchanger may be inserted in the flow following discharge port 38 and ahead of intake port 40 to remove the first stage heat of compression.

Figure 2:
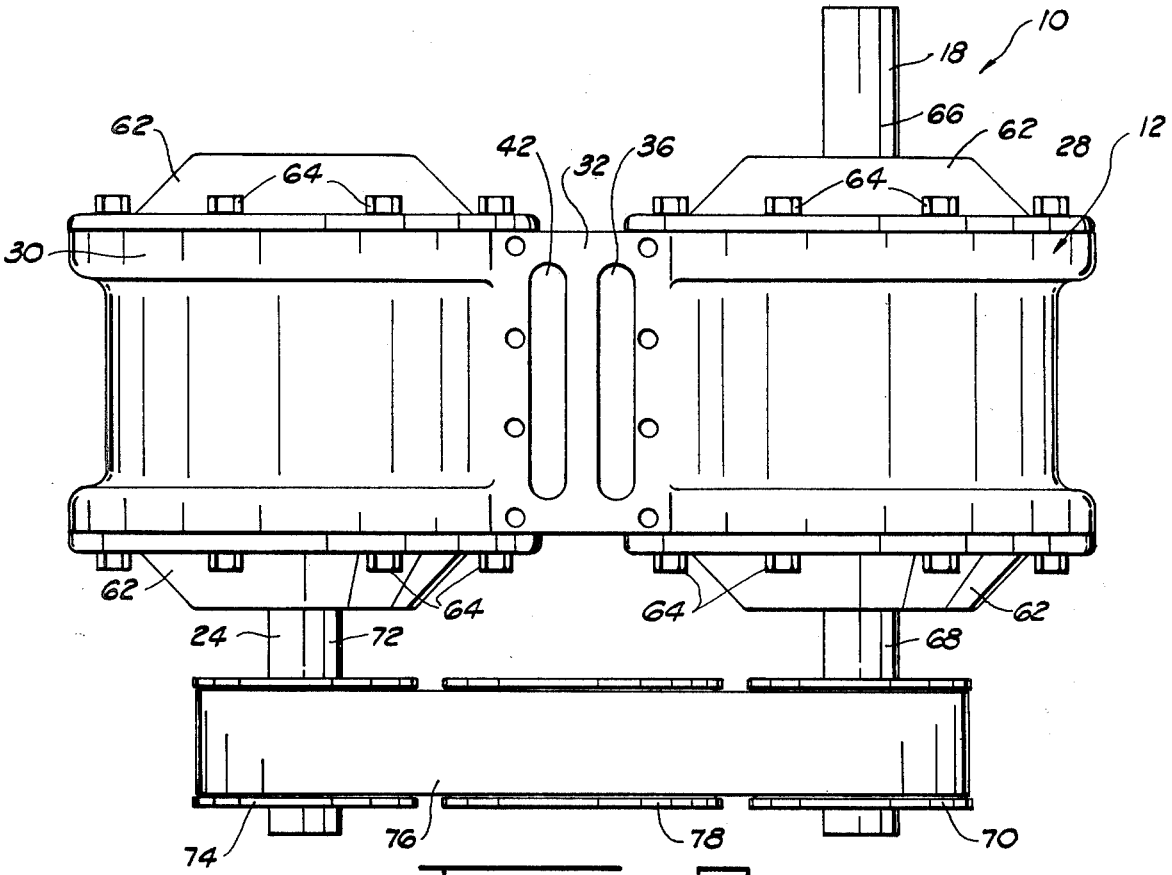
FIG. 2 is a top view of the improved fluid pump.

In FIG. 2 a top view of the pump 10 is seen with end plates 62 of the pump 10 attached to the sides of the housing 12. In this view a top view of the intake port 36 and discharge port 42 are shown and as described under FIG. 1. The end plates 62 of the pump 10 are attached by bolts 64 screwed into the sides of the housing 12.

The first rotor shaft 18 is shown having a first end portion 66 and a second end portion 68 extending from the housing 12. The first end portion 66 is connected to a drive motor which is not shown. The drive motor drives the pump 10. A first drive pulley 70 is connected to the second end portion 68 of the first rotor shaft 18. The second rotor shaft 24 includes a first end portion 72 having a second drive pulley 74 attached thereto. The first rotor shaft 18 drives the second rotor shaft 24 by connecting the first drive pulley 70 and the second drive pulley 74 with a timing drive 76 or other synchronous drive means. An idler pulley 78 may be provided between first drive pulley 70 and second drive pulley 74 to control belt tension if a timing belt is used. Other types of synchronous drives such as gears, bar linkage or chains may not require tension control.

Figure 3:
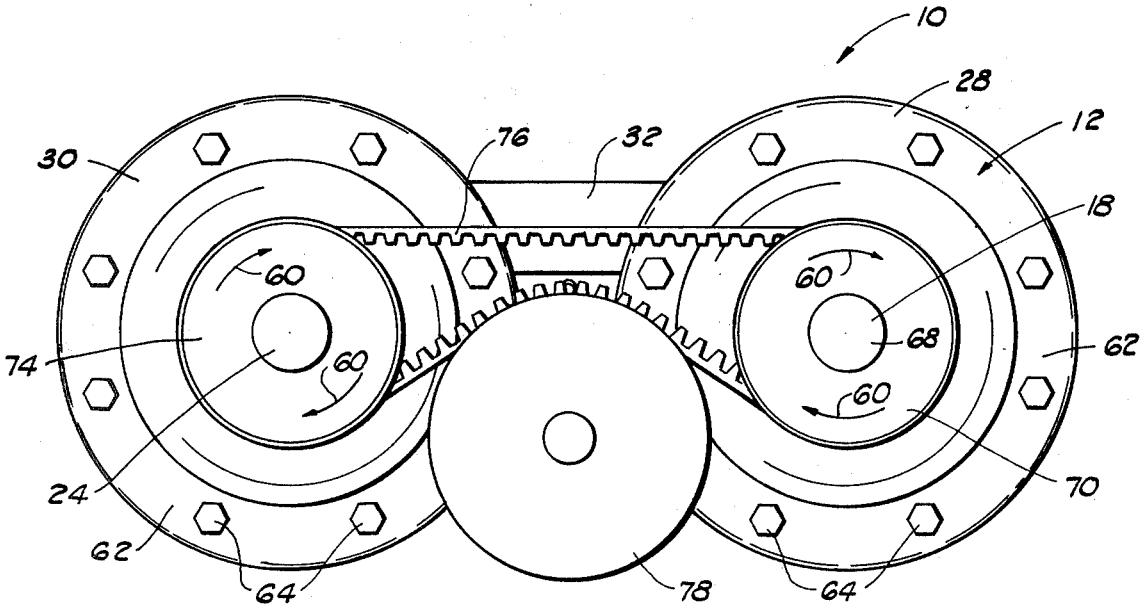
FIG. 3 is a side view of the improved fluid pump as shown in FIG. 2.

In FIG. 3 a side view of the pump 10 is seen as shown in FIG. 2. In this view the drive belt 76 can be seen attached to the first drive pulley 70 and the second drive pulley 74 with the idler pulley 78 positioned therebetween.

The first rotor shaft 18 and the second rotor shaft 24 are driven in the same direction as indicated by the arrows 60. Also it is understood that chain drives could be used or any other method well known in the art for driving rotor shafts.

Changes may be made in the construction and arrangement of the parts or elements of the embodiments as disclosed herein without departing from the spirit or scope of the invention as defined in the following claims.

I claim:

1. A fluid pump for compressing fluid therein, the pump comprising:

a pump housing having a first end portion, a second end portion and a center portion;

a first cylindrical chamber in the first end portion of said housing;

a first cylindrical eccentric rotor positioned in said first chamber and rotatably attached to said housing;

a first intake port in the center portion of said housing and connected to said first chamber;

a first discharge port on the center portion of said housing and connected to said first chamber;

a second cylindrical chamber in the second end portion of said housing and parallel to said first chamber;

a second cylindrical eccentric rotor positoned in said second chamber and rotatably attached to said housing;

a second intake port in the center portion of said housing and connected to said second chamber;

a second discharge port in the center portion of said housing and connected to said second chamber;

an angular shaped guideway in the center portion of said housing and therethrough, said guideway interconnecting said first chamber and said second chamber;

a rectangular shaped floating block slidably received in said guideway, the ends of said block disposed adjacent a portion of the cylindrical surface of said first and said second rotors as said rotors rotate in said chambers, the sides of said block disposed adjacent said guideway, the width of said guideway sufficient to provide clearance between the sides of said block and said guideway so that in operation the pressure differential between said first chamber and said second chamber provides fluid pressure between the sides of said block and said guideway thereby providing a fluid bearing therebetween; and drive means for rotating said first and second rotors in said first and second chambers.

2. The pump as described in claim 1 wherein, clearance is provided between the ends of said floating block and the cylindrical surface of said first and second rotor so that in operation the pressure differential between the intake ports and the discharge ports in said chambers provides fluid pressure between the cylindrical portions of said first rotor and said second rotor and the ends of said floating block thereby providing a fluid bearing therebetween.

3. The pump as described in claim 2 wherein, the surface of said floating block is comprised of a solid lubricant such as graphite, teflon, molybdenum or the like, so that lubrication is provided between said block, the sides of said guideway, and the portions of the cylindrical surface of said first and second rotors contacted by the ends of said block during the startup of the pump.

4. The pump as described in claim 1 wherein, said drive means comprises:

a first rotor shaft integrally attached to said first rotor, said first shaft rotatably mounted in said housing;

a second rotor shaft integrally attached to said rotor, said second shaft rotatably mounted in said housing;

a drive motor attached to one end of said first shaft; and connecting means attached to the opposite end of said first shaft and one end of said second shaft for rotating said second shaft when said first shaft is rotated by said drive motor.

5. The pump as described in claim 4 wherein, said connecting means may be a belt drive, gear drive, chain drive or the like.

* * * * *